US007223930B2

(12) United States Patent
Silva et al.

(10) Patent No.: US 7,223,930 B2
(45) Date of Patent: May 29, 2007

(54) ENCASED STARTING SWITCH CONTACT ASSEMBLY PROTECTED AGAINST DUST AND SMALL PARTICLES FOR A SINGLE-PHASE ROTATING ELECTRIC MACHINE AND A METHOD OF ASSEMBLING SAID SWITCH

(75) Inventors: Marcelo De Melo Silva, Jaragua do Sul (BR); Valmir Luís Stoinski, Jaragua do Sul (BR)

(73) Assignee: Weg Industrias S.A., Jaragua Do Sul Santa Catarina (BR)

( * ) Notice: Subject to any disclaimer, the term of this patent is extended or adjusted under 35 U.S.C. 154(b) by 137 days.

(21) Appl. No.: 11/077,639

(22) Filed: Mar. 10, 2005

(65) Prior Publication Data

US 2006/0027449 A1 Feb. 9, 2006

(30) Foreign Application Priority Data

Aug. 5, 2004 (BR) ..... 0404228

(51) Int. Cl.
*H01H 9/00* (2006.01)

(52) U.S. Cl. ..... 200/80 R; 200/302.1

(58) Field of Classification Search ..... 200/80 R, 200/302.1–302.3; 73/535; 310/68 E
See application file for complete search history.

(56) References Cited

U.S. PATENT DOCUMENTS

| | | | | | |
|---|---|---|---|---|---|
| 2,662,143 | A | * | 12/1953 | Eckles | 200/302.1 |
| 2,816,199 | A | | 12/1957 | Staak | |
| 3,015,011 | A | * | 12/1961 | Seagreaves | 200/302.1 |
| 4,289,988 | A | | 9/1981 | Schaefer | |
| 4,414,443 | A | * | 11/1983 | Gehrt | 200/80 R |
| 4,922,066 | A | * | 5/1990 | Crow et al. | 200/80 R |
| 4,927,988 | A | | 5/1990 | Nolte | |
| 5,283,405 | A | * | 2/1994 | Nolte et al. | 200/80 R |
| 5,285,035 | A | * | 2/1994 | Williams et al. | 200/80 R |
| 5,403,982 | A | * | 4/1995 | Nolte et al. | 200/80 R |

* cited by examiner

*Primary Examiner*—Michael A. Friedhofer
(74) *Attorney, Agent, or Firm*—Darby & Darby

(57) ABSTRACT

The present invention refers to a starting switch having a protection against dust and small particles for rotating electric machines and to a method of assembling said switch. The switch according to the present invention provides an easy-to-assembly system for the several components that are part of the switch that does not require massive investments when compared to similar systems known to the state of the art while still providing an easy assembly due to the features of each component in the switch.

5 Claims, 2 Drawing Sheets

Cut A-A

Cut A-A

ENCASED STARTING SWITCH CONTACT ASSEMBLY PROTECTED AGAINST DUST AND SMALL PARTICLES FOR A SINGLE-PHASE ROTATING ELECTRIC MACHINE AND A METHOD OF ASSEMBLING SAID SWITCH

CROSS-REFERENCE TO RELATED APPLICATION

This application claims priority under 35 U.S.C. §119 of Brazilian patent application no. PI 0404224-0, filed Aug. 5, 2004, which is incorporated by reference herein.

BACKGROUND OF THE INVENTION

1. Field of the Invention

The present invention refers to a starting switch having a protection against dust and small particles for rotating electric machines and to a method of assembling said switch.

2. Description of the Related Art

The protection of starting switches has been studied for years by the manufacturers of several types of rotating electric machines. This is due to the fact that these switches usually operate in harsh environments, including some that may contain corrosive chemical substances and hazardous particles. Also, some environments may have high humidity levels, and the combination of these contaminant elements may accelerate the deterioration of the active components of the starting switch, thereby jeopardizing its good operation and limiting its useful life.

Typically, a rotating electric machine is used to operate a saw or similar equipment and the chipped wood and dust resulting from the cutting process usually creates an environment that is very aggressive to the switch.

In yet another case, in an environment where cotton is manufactured, small particles of cotton in suspension in the air, when put in contact with the energized parts of the switch they may cause combustion due to the occurrence of sparks in the starting switch during its operation.

Another example of a harsh environment are the nautical applications, where the presence of salt spray penetrates into the parts of the electric machine, causing premature corrosion of the conductive parts.

Another concern is the presence of insects in some applications, which insects might as well enter the equipment and settle near the conducting parts of the contact, lately impairing its operation.

Open electric machines have been used for years as they are cheaper and more compact. In this case, a solution for those environments would be the use of an encased electric machine. However, in addition to the problem of dissipating the heat generated by the machine in an encased construction, the increase in the manufacturing costs of such equipment is evident as more material is required to obtain the same power from the equipment due to the loss by heat.

The size-costs related to the increased use of copper, steel and weight are the main consequences of the use of encased machines and are good reasons for the use of open electric machines wherever the application allows, even in contaminated environments that may affect performance.

A number of the rotating electric machines used in the above-described examples have a starting capacitor or are of the split-phase type. Typically, an auxiliary winding, usually driven by a centrifugal actuator disk, is required to help start a single-phase electric machine having such a design, which winding activated until the machine reaches its working speed, after which it is necessary to switch off the auxiliary winding.

The centrifugal actuator is fixed to the shaft of the machine and is designed in such a manner that at the right time, that is, when the machine reaches its ideal rotating speed, it is axially displaced to release the contacts, thereby opening the connection and switching off the auxiliary winding. From that point on, the main winding has enough torque to fully operate the machine.

If the auxiliary winding does not act together with the starting switch and the centrifugal actuator, this is an indication of engine failure and of the need of maintenance and cleaning of the set, which causes losses and drawbacks in the operation of the machine.

Therefore, it is highly desirable a design that provides a resistant and low maintenance switching assembly, preferably an assembly that dispenses maintenance.

Several types of starting switches are similar in operation. U.S. Pat. No. 4,289,988 is an example of such starting switches. Other switches incorporate protection systems as disclosed in U.S. Pat. Nos. 2,816,199 and 4,927,988, which describe dust-proof mechanisms.

Generally speaking, a switching assembly as disclosed in U.S. Pat. Nos. 2,816,199 and 4,927,988 consists of a thin flexible plate made from a bronze-alloy or another good conductor material resistant to voltaic arcs, fixed at one end to a support having a cylindrical contact made of a silver alloy or another excellent conductor material, which when at a static condition another cylindrical contact made of a silver alloy to command, through the centrifugal actuator, the opening and closing of the contacts to start or switch off the auxiliary winding.

In more modern dust-protection systems, the gap between the contacts is insulated to keep the surfaces of the contacts clean of any dust. When these systems are compared with the ones cited as examples of the state of art, it is easy to notice the use of a flexible cylindrical casing structure, as it is the case of U.S. Pat. No. 4,927,988, which casing is also shown in other switches.

SUMMARY OF THE INVENTION

The object of the present invention is to provide an encased starting switch contact assembly protected against dust and small particles for a single-phase rotating electric machine comprising: an auxiliary winding to start the machine until it reaches an operational speed; a mechanical starting switch consisting of a pair of blades made of a conducting material having highly conductive contacts at one of their ends, said blades movable between a first position where the contacts are in contact with each other to turn on the auxiliary winding and start the machine and a second position where the contact are apart from each other when the machine is running at an operational speed, thereby turning off said auxiliary winding; an actuating disk for moving said contacts between said first and second positions; a centrifugal actuator for driving said actuating disk; and a casing covering said contacts to protect against dust and small particles, wherein said casing comprises a substantially "L" shaped body defining a cylindrical main portion and a leg portion radially extending in a plane perpendicular to the axis of said main portion, said main portion having a first opening at its upped end and said leg having a second, elongated opening at its distal end.

Another object of the present invention is to provide an encased starting switch contact assembly as defined above, wherein the cylindrical main portion of said substantially "L" shaped body has a thin barreled wall to yield a minimum resistance to the movement of said contacts between said first and second positions.

Still another object of the present invention is to provide an encased starting switch contact assembly as defined above wherein each conducting contact has contact has a rivet at its end.

A further object of the present invention is to provide an encased starting switch contact assembly as defined above wherein said casing is mounted on said contacts to protect them against dust and small particles.

The present invention also refers to a method of assembling an encased starting switch contact assembly, as described above, protected against dust and small particles for a single-phase rotating electric machine, said method includes the steps of mounting a first conductive contact to the free end of a first conducting blade; mounting a second conductive contact to the free end of a second flexible conducting blade; mounting a prop washer to said second flexible conducting blade; positioning the casing over the ends of said first and second conducting blades to encase both said first and second conductive contacts and define a pre-assembled set; mounting said pre-assembled set to a support element.

Other objects and characteristics of the present invention will be apparent from the following detailed description of the preferred embodiment, taken in conjunction with the accompanying drawings.

BRIEF DESCRIPTION OF THE SEVERAL VIEWS OF THE DRAWINGS

The present invention will be additionally described hereinafter, as a non-limiting example, with reference to its presently preferred embodiment illustrated in the accompanying drawings, wherein.

DETAILED DESCRIPTION OF THE INVENTION

A specific embodiment presently preferred of the present invention is illustrated as an example in the accompanying drawings and will be described in details hereinafter. However, it should be understood that though the present invention is susceptible to several modifications and alterations in the form and dimensions, the purpose of the present specification is not to limit same to the particular forms and/or dimensions described herein but, instead, to cover all the modifications and alternative embodiments that are within the spirit and scope of the invention, as defined by the accompanying claims.

Figure 1:
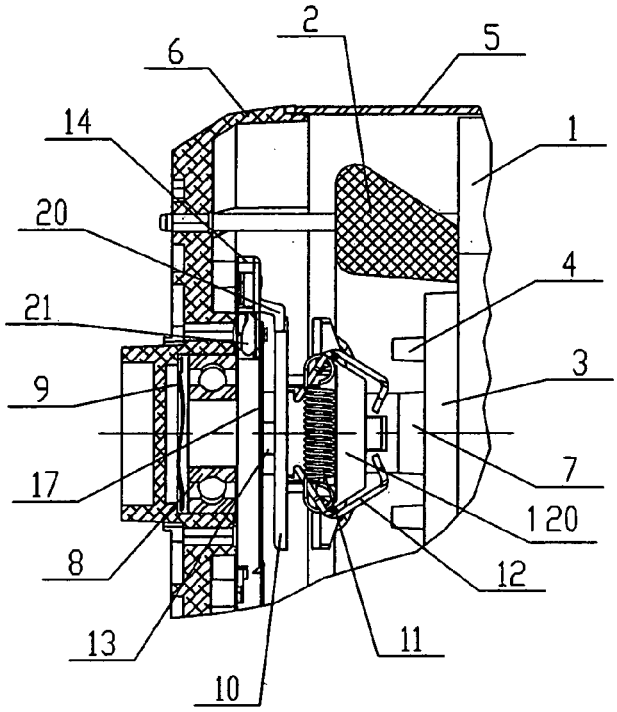
FIG. 1 is a partial section view of an electric machine incorporating the encased starting switch contact assembly protected against dust and small particles according to the present invention, shown positioned on the shaft of an electric machine.

With reference now more particularly to the accompanying Figures, in which the same numerals have been used to indicate the same elements in the different views and, with particular reference to FIG. 1, an electric machine motor is shown in cross-sectional view in order to clarify its operation and the way the components involved in this process act.

The switch comprises an induction stator 1, the induction stator winding followed by a squirrel cage rotor 3 and balance pins 4 of the rotor 3. These are the main components of a machine having a squirrel cage rotor 3.

To support its operation, the stator 1 is fit into a frame 5 by dimensional interference, and a cover 6 is provided to axially support the assembly through a bearing 8, wave washer 9 and shaft 7, which closes the cycle, all parts being assembled to the rotor 3 through dimensional interference.

The on-off switching system of the auxiliary winding 2 is done by two components: a centrifugal set 120, which actuates through an actuator disk 10 which, through springs 11 and the centrifugal support 12 when the previously established ideal speed is reached, is opened by a centrifugal force to displaces the actuating disk 10, which releases the prop washer 13 of low friction material, displacing the blade 17 and the bimetallic contact 18 responsible for the connection of the auxiliary winding 2 and switching off the auxiliary winding 2.

Figure 3:
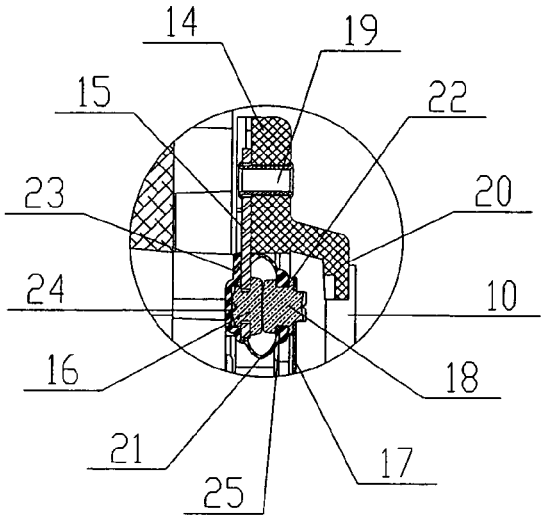
FIG. 3 is a cross-sectional view showing the casing region of FIG. 1, with the motor at rest mode.

With reference now to FIG. 3, the second component of the on-off switching system for the auxiliary winding 2 is switch 20, which comprises a base 14 made of a material resistant to humidity and with good thermal insulation, through which the electric feeding in one side connected to a conducting blade 15 and to an electric contact 16 may form one side of the switch. The conducting blade 15 is mounted to the base by a rivet 19 and on the other side a flexible conducting blade 17 of a conducting material together with another electric contact 18 may form the other side of the switch electrical feeding on one side, connected to a conducting blade 15 and to a conducting electrical contact 16 form one side of the switch.

Still with reference to FIG. 3, the main component of the invention is the casing 21, responsible for providing protection against small dust particles or dirt.

Casing 21 comprises a substantially "L" shaped body defining a cylindrical main portion and a leg portion radially extending in a plane perpendicular to the axis of said main portion, said main portion having a first opening 25 at its upped end and said leg having a second, elongated opening 23 at its distal end.

Casing 21 is mounted to contact 18 by its a first opening 25 through a neck 22 in contact 18 and is mounted fixed to contact 16 and to conducting blade 15 through its elongated opening 23.

Contact 16 also has a highly conductive rivet 24 mounted on its conducting blade 15 in such a way that there is no sharp edge or burr. It is important to point out that the casing 21 remains compressed when the motor is at rest, and it goes back to its original position when the motor is operating.

Figure 2:
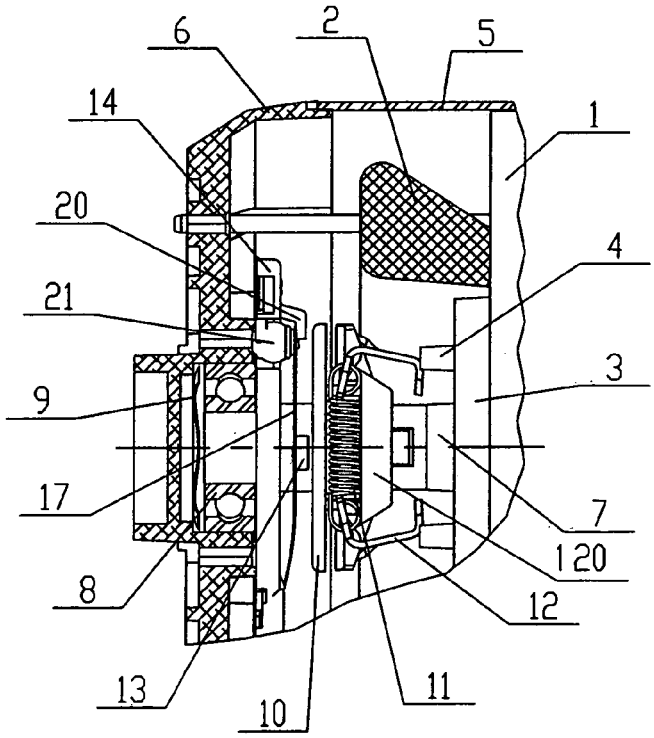
FIG. 2 is a partially sectional view of an electric machine incorporating the encased starting switch contact assembly protected against dust and small particles according to the present invention, this time with the contacts in open position and the machine at operating mode.

FIG. 2 shows the operation principle of FIGS. 1 and 3. It shows, however, the casing 21 in its open position.

Figure 4:
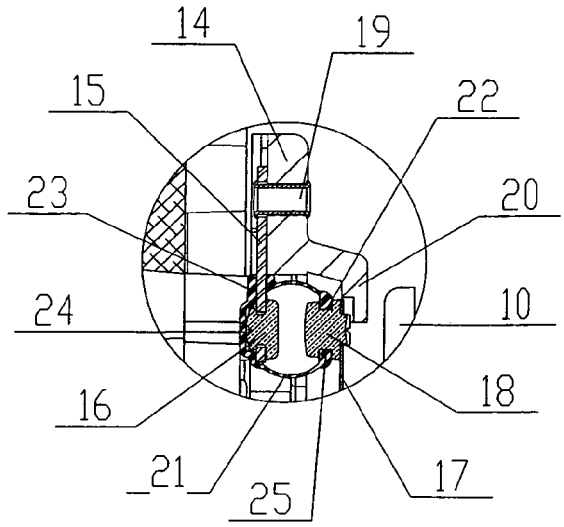
FIG. 4 is a cross-sectional view showing the casing region of FIG. 2, with the motor at full operation mode.

With reference now to FIG. 4, it follows the same principles of FIG. 2, showing contacts 16 and 18 in their open position, that is, after the machine has reached its ideal speed to switch off auxiliary winding 2.

The centrifugal set 120 displaces the actuating disk 10 together with the prop washer 13, the flexible conducting blade 17 and the contact 18, moving said contact 18 away from contact 16 and stretching casing 21.

Figure 5:
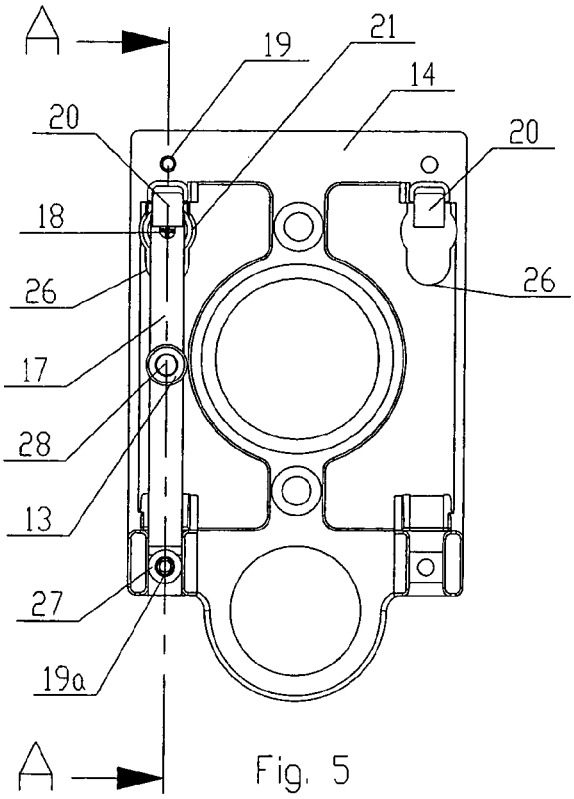
FIG. 5 is a front elevation view of the encased starting switch contact assembly according to the present invention mounted on the support base of the contact points.
Figure 6:
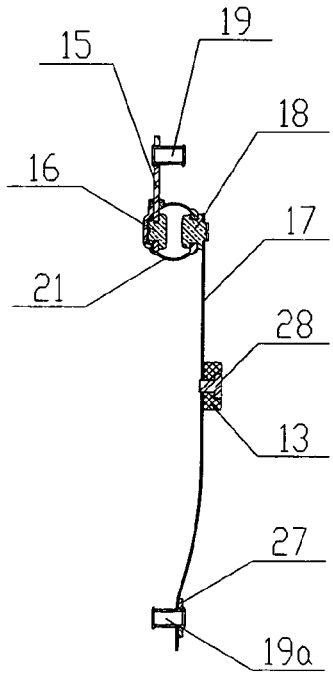
FIG. 6 is a cross-sectional view taken along lines A—A of FIG. 5 without the support base, showing the encased starting switch contact assembly protected against dust and small particles according to the present invention.

With reference to FIGS. 5 and 6, support base 14 has a casing opening 26 to receive casing 21, which allows great easiness in the assembly process, where conducting blade 15, contact 16 having the casing 21 mounted thereon, contact 18, flexible conducting blade 17, prop washer 13, rivet 28 and washer 27, all previously sub-assembled, properly accommodated on the support base 14 and then riveting those components through rivets 19 and 19*a*, as shown in FIG. 6.

The method of assembling the encased starting switch contact assembly as described above includes the steps of mounting a first conductive contact 16 to the free end of a first conducting blade 15; mounting a second conductive contact 18 to the free end of a second flexible conducting blade 17; mounting a prop washer 13 to said second flexible conducting blade 17; positioning the casing 21 over the ends of said first and second conducting blades 15, 17 to encase both said first and second conductive contacts 16, 18 and define a pre-assembled set; mounting said pre-assembled set to a support base 14.

Having been described and illustrated the best form of embodiment currently contemplated for the present invention, several modifications and variations will be readily apparent to those skilled in the art. Therefore, it is to be understood that the present invention is not limited to the practical aspects of the presently preferred embodiment illustrated and described herein, and that all such modifications and variations should be considered as being encompassed within the spirit and scope of the invention, such as defined in the accompanying claims.

The invention claimed is:

1. An encased starting switch contact assembly protected against dust and small particles for a single-phase rotating electric machine, comprising:

an auxiliary winding to start the machine until it reaches an operational speed;

a mechanical starting switch consisting of a pair of blades made of a conducting material having highly conductive contacts at one of their ends, said blades movable between a first position where the contacts are in contact with each other to turn on the auxiliary winding and start the machine and a second position where the contacts are apart from each other when the machine is running at the operational speed, thereby turning off said auxiliary winding;

an actuating disk for moving said contacts between said first and second positions;

a centrifugal actuator for driving said actuating disk; and a casing covering said contacts to protect them against dust and small particles, wherein said casing comprises a substantially "L" shaped body defining a cylindrical main portion and a leg portion radially extending in a plane perpendicular to the axis of said main portion, said main portion having a first opening at its upper end and said leg having a second, elongated opening at its distal end.

2. The encased starting switch contact assembly as defined in claim 1, wherein the cylindrical main portion of said substantially "L" shaped body has a thin barreled wall to yield a minimum resistance to the movement of said contacts between said first and second positions.

3. The encased starting switch contact assembly as defined in claim 1, wherein each conducting contact has a highly conductive contact mounted at its end.

4. The encased starting switch contact assembly as defined in claim 3, wherein said casing is mounted on said highly conductive contacts to protect them against dust and small particles.

5. A method of assembling an encased starting switch contact assembly protected against dust and small particles for a single-phase rotating electric machine comprising the steps of:

mounting a first conductive contact to the free end of a first conducting blade;

mounting a second conductive contact to the free end of a second flexible conducting blade;

mounting a prop washer to said second flexible conducting blade;

positioning the casing over the ends of said first and second conducting blades to encase both said first and second conductive contacts and define a pre-assembled set; and mounting said pre-assembled set to a support element.

* * * * *